US008000632B2

(12) United States Patent
Murao

(10) Patent No.: US 8,000,632 B2
(45) Date of Patent: Aug. 16, 2011

(54) IMAGE FORMING APPARATUS AND IMAGE FORMING METHOD

(75) Inventor: Hidetoshi Murao, Mishima (JP)

(73) Assignees: Kabushiki Kaisha Toshiba, Tokyo (JP); Toshiba Tec Kabushiki Kaisha, Toyko (JP)

( * ) Notice: Subject to any disclaimer, the term of this patent is extended or adjusted under 35 U.S.C. 154(b) by 573 days.

(21) Appl. No.: 12/126,534

(22) Filed: May 23, 2008

(65) Prior Publication Data

US 2008/0298864 A1 Dec. 4, 2008

Related U.S. Application Data

(60) Provisional application No. 60/940,254, filed on May 25, 2007, provisional application No. 60/969,587, filed on Aug. 31, 2007.

(51) Int. Cl.
*G03G 15/14* (2006.01)
*G03G 15/16* (2006.01)
*G03G 21/00* (2006.01)

(52) U.S. Cl. ..... 399/121; 399/302; 399/308

(58) Field of Classification Search ..... 399/121, 399/297, 298, 302, 308, 313
See application file for complete search history.

(56) References Cited

U.S. PATENT DOCUMENTS 6,690,905 B2 * 2/2004 Takahashi et al. ..... 399/302
2005/0254853 A1 * 11/2005 Yoshida ..... 399/101

FOREIGN PATENT DOCUMENTS

JP 10039661 A * 2/1998
JP P2001-142322 A 5/2001
JP P2001-318543 A 11/2001
JP P2001-356619 A 12/2001
JP 2003076159 A * 3/2003
JP 2006091122 A * 4/2006
JP 2007-264546 10/2007

* cited by examiner

*Primary Examiner* — David M Gray
*Assistant Examiner* — Fred Braun
(74) *Attorney, Agent, or Firm* — Patterson & Sheridan, LLP

(57) ABSTRACT

An image forming apparatus includes an image transfer unit that transfers a reversed image onto an image bearing member as a toner image, a secondary transfer roller that transfers the toner image onto a recording medium, a contact and separation unit that brings the secondary transfer roller into contact with and separates the secondary transfer roller from the image bearing member, a secondary-transfer-roller housing unit that houses the secondary transfer roller, a lubricant applying brush that applies a lubricant thereto, a lubricant-applying-brush housing unit that houses the lubricant applying brush and is configured to be movable along a groove, and an lifting and lowering member that lifts and lowers the lubricant-applying-brush housing unit, wherein the secondary transfer roller and the lubricant applying brush come into contact with and separate from each other in response to a contact and separation operation of the secondary transfer roller and the image bearing member.

11 Claims, 9 Drawing Sheets

IMAGE FORMING APPARATUS AND IMAGE FORMING METHOD

CROSS-REFERENCE TO RELATED APPLICATION

This application is based upon and claims the benefit of U.S. Provisional Applications No. 60/940,254, filed May 25, 2007; and No. 60/969,587, filed Aug. 31, 2007.

BACKGROUND OF THE INVENTION

1. Field of the Invention

The present invention relates to an image forming apparatus including, in a secondary transfer unit having a mechanism for bringing a secondary transfer roller into contact with and separating the secondary transfer roller from an image bearing member, a mechanism for further bringing the secondary transfer roller into contact with and separating the secondary transfer roller from a fur brush and an image forming method therefor.

2. Description of the Related Art

A transfer device includes a contact and separation mechanism for bringing a secondary transfer roller into contact with an image bearing member when the transfer device transfers a toner image formed on the image bearing member onto a sheet and separating the secondary transfer roller from the image bearing member when the transfer device does not transfer the toner image onto the sheet.

There is known a contact and separation driving device for a secondary transfer roller in which, in a secondary transfer unit having a mechanism for bringing a secondary transfer roller into contact with and separating the secondary transfer roller from an image bearing member, the number of components of a mechanism unit configuring the mechanism for performing a contact and separation operation is not increased and a device such as an electromagnetic clutch that requires electric control is not used (JP-A-2007-264546).

BRIEF SUMMARY OF THE INVENTION

An image forming apparatus according to a first aspect of the present invention includes an image transfer unit that transfers a reversed image based on a scanned original image onto an image bearing member as a toner image, a secondary transfer roller that comes into contact with the image bearing member and transfers the toner image onto a recording medium, a contact and separation unit that brings the secondary transfer roller into contact with and separates the secondary transfer roller from the image bearing member, a secondary-transfer-roller housing unit that houses the secondary transfer roller, a lubricant applying brush that comes into contact with the secondary transfer roller and applies a lubricant thereto, a lubricant-applying-brush housing unit that houses the lubricant applying brush and is configured to be movable along a groove provided in the secondary-transfer-roller housing unit, and an lifting and lowering member that is provided in another member not associated with the secondary-transfer-roller housing unit and lifts and lowers the lubricant-applying-brush housing unit, wherein the secondary transfer roller and the lubricant applying brush come into contact with and separate from each other in response to a contact and separation operation of the secondary transfer roller and the image bearing member.

An image forming method according to a second aspect of the present invention is an image forming method for an image forming apparatus including an image transfer unit configured to transfer a reversed image based on a scanned original image onto an image bearing member as a toner image, a secondary transfer roller that comes into contact with the image bearing member and transfers the toner image onto a recording medium, and a contact and separation unit configured to bring the secondary transfer roller into contact with and separate the secondary transfer roller from the image bearing member, comprising: contacting the secondary transfer roller and a lubricant applying brush with and separating from each other in response to a contact and separation operation of the secondary transfer roller and the image bearing member, wherein the image forming apparatus includes a secondary-transfer-roller housing unit configured to house the secondary transfer roller, the lubricant applying brush that comes into contact with the secondary transfer roller and applies a lubricant thereto, a lubricant-applying-brush housing unit configured to house the lubricant applying brush and to be movable along a groove provided in the secondary-transfer-roller housing unit, and an lifting and lowering member that is provided in another member not associated with the secondary-transfer-roller housing unit and lifts and lowers the lubricant-applying-brush housing unit.

Additional objects and advantages of the invention will be set forth in the description which follows, and in part will be obvious from the description, or may be learned by practice of the invention. The objects and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

First Embodiment

Figure 1:
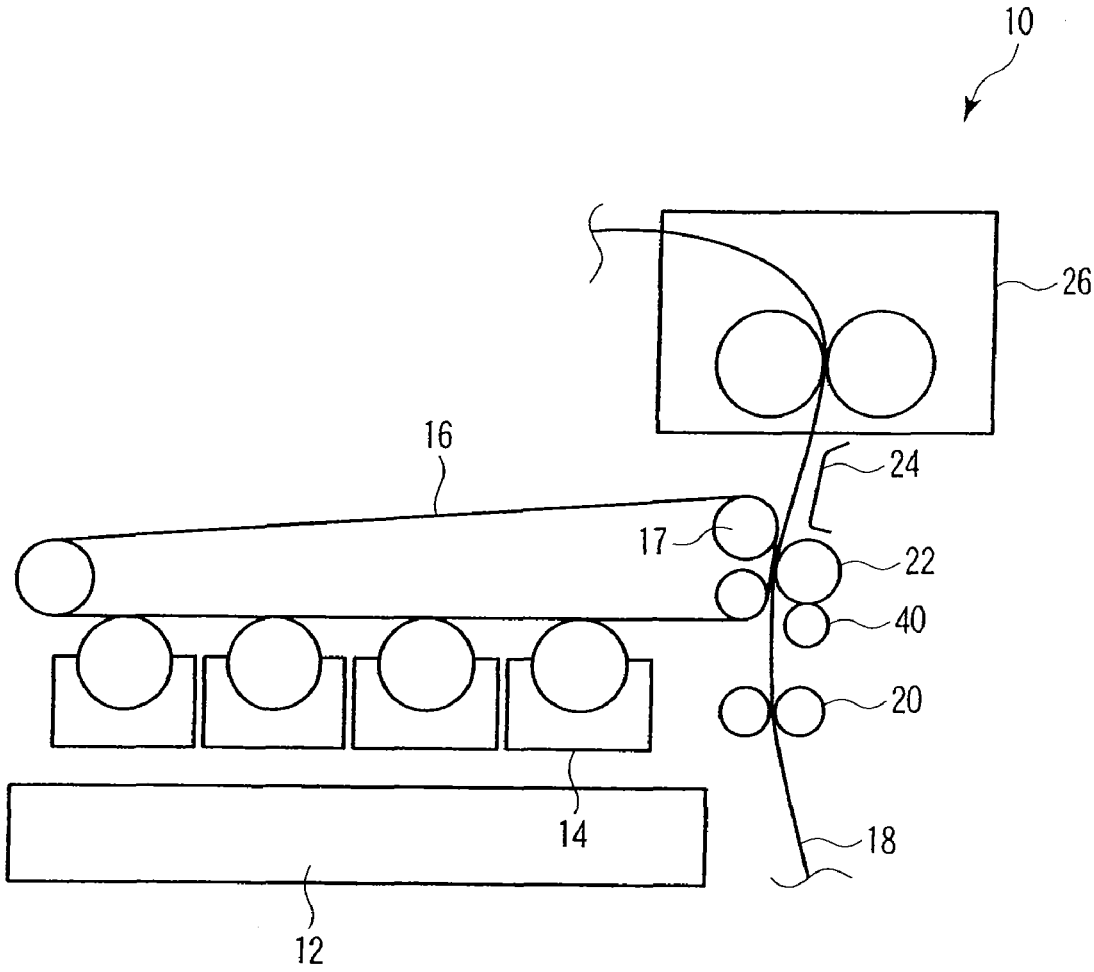
FIG. 1 is a schematic diagram of an image forming unit of an image forming apparatus according to a first embodiment of the present invention.
Figure 2:
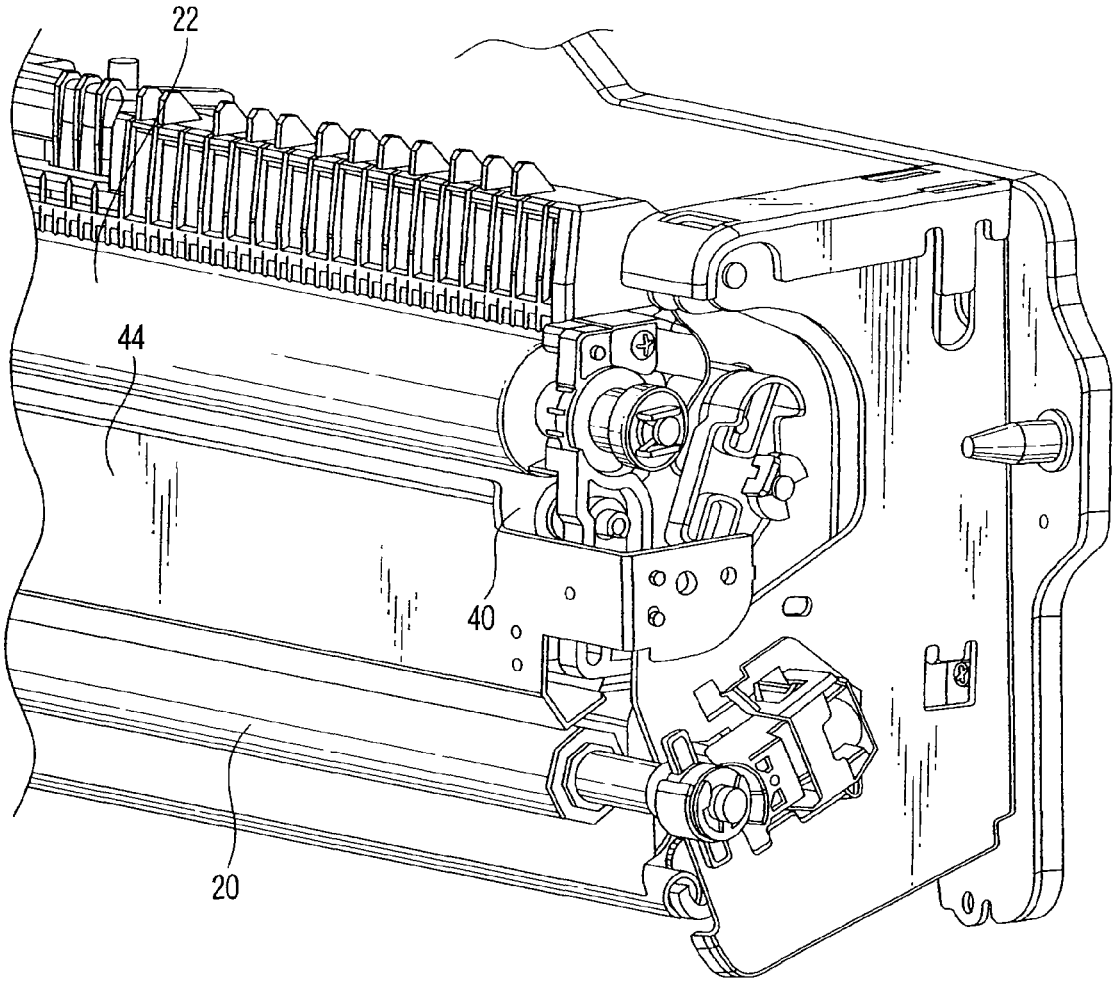
FIG. 2 is a perspective view showing the structure of a secondary transfer unit.
Figure 3:
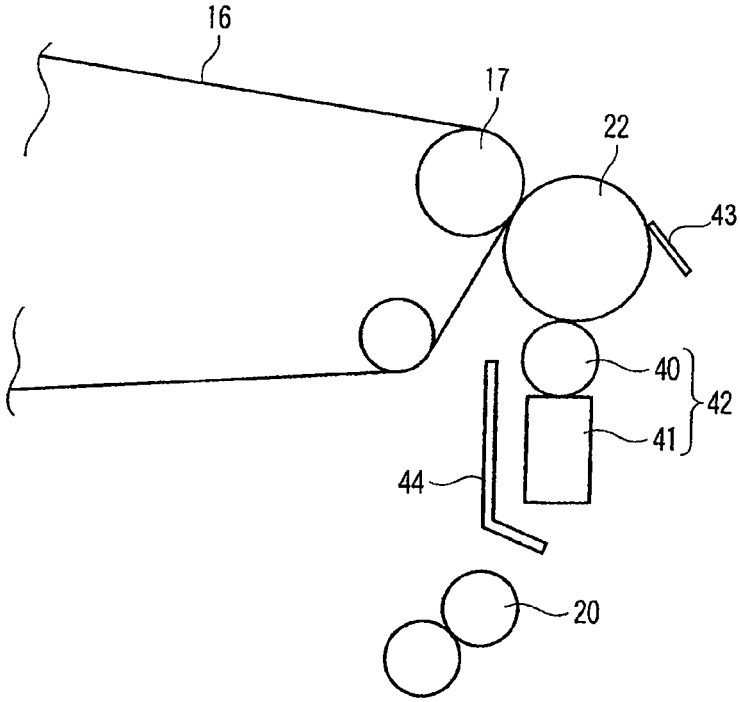
FIG. 3 is a side view of the secondary transfer unit.

FIG. 1 is a schematic diagram of an image forming unit of an image forming apparatus according to a first embodiment of the present invention. FIG. 2 is a perspective view showing the structure of a secondary transfer unit. FIG. 3 is a side view of the secondary transfer unit.

As shown in FIG. 1, an image forming unit 10 includes a laser unit 12, developing devices 14, a transfer belt (an image bearing member) 16, a counter roller 17, a sheet conveying path 18, registration rollers 20, a secondary transfer roller 22, a fur brush 40, a conveyance guide 24, and a fixing device (a fixing unit) 26.

The laser unit 12 irradiates a laser beam optically modulated according to an image signal of an original scanned by a not-shown scanner unit or an image signal inputted from an external apparatus and forms electrostatic latent images on the developing devices 14. The developing devices 14 reversely develop the electrostatic latent images and transfer toner images onto the transfer belt 16.

The sheet conveying path 18 is a conveying path for a sheet fed from a not-shown paper feeding unit. The registration rollers 20 correct inclination of the sheet immediately before an image is transferred thereon. The secondary transfer roller 22 is arranged downstream of the registration rollers 20 and opposed to the counter roller 17 to be capable of coming into contact with the transfer belt 16. When the sheet passes between the transfer belt 16 and the secondary transfer roller 22, the toner images are collectively transferred onto the sheet. The conveyance guide 24 guides the sheet, which is conveyed out from the secondary transfer roller 22, to the fixing device 26. The fixing device 26 fixes an image transferred by the secondary transfer roller 22 on the sheet.

As shown in FIGS. 2 and 3, the fur brush 40 and a lubricant case 41 that comes into press contact with the fur brush 40 and supplies a lubricant (zinc stearate) thereto are provided below the secondary transfer roller 22. In the following explanation, a unit configured by integrating the fur brush 40 and the lubricant case 41 is referred to as fur brush unit 42. A cleaning blade 43 that scrapes off a residual toner adhering to the secondary transfer roller 22 is in contact with the secondary transfer roller 22. A pre-transfer guide 44 is fixedly provided between the fur brush unit 42 and the sheet conveying path 18.

Figure 4:
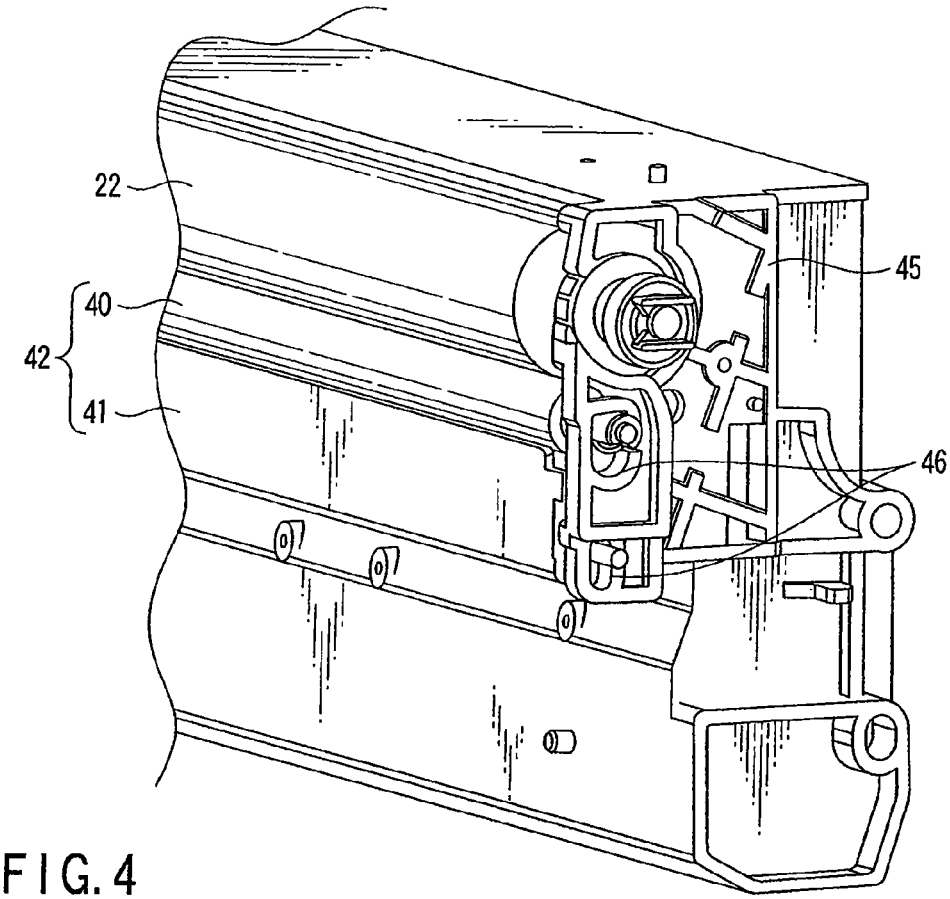
FIG. 4 is a diagram showing ends of a secondary transfer roller and a fur brush unit in a state in which a pre-transfer guide is removed.

FIG. 4 is a diagram showing ends of the secondary transfer roller 22 and the fur brush unit 42 in a state in which the pre-transfer guide 44 is removed.

A bearing of the secondary transfer roller 22 is held by a secondary-transfer-roller holding case 45. The secondary-transfer-roller holding case 45 has a guide groove 46 for guiding the fur brush unit 42 up and down. In the fur brush unit 42, two shafts are provided on each of a front side and a rear side of the secondary transfer unit. The two shafts provided on each of the front side and the rear side move up and down along the guide groove 46, whereby the fur brush unit 42 is capable of moving up and down.

Figure 5:
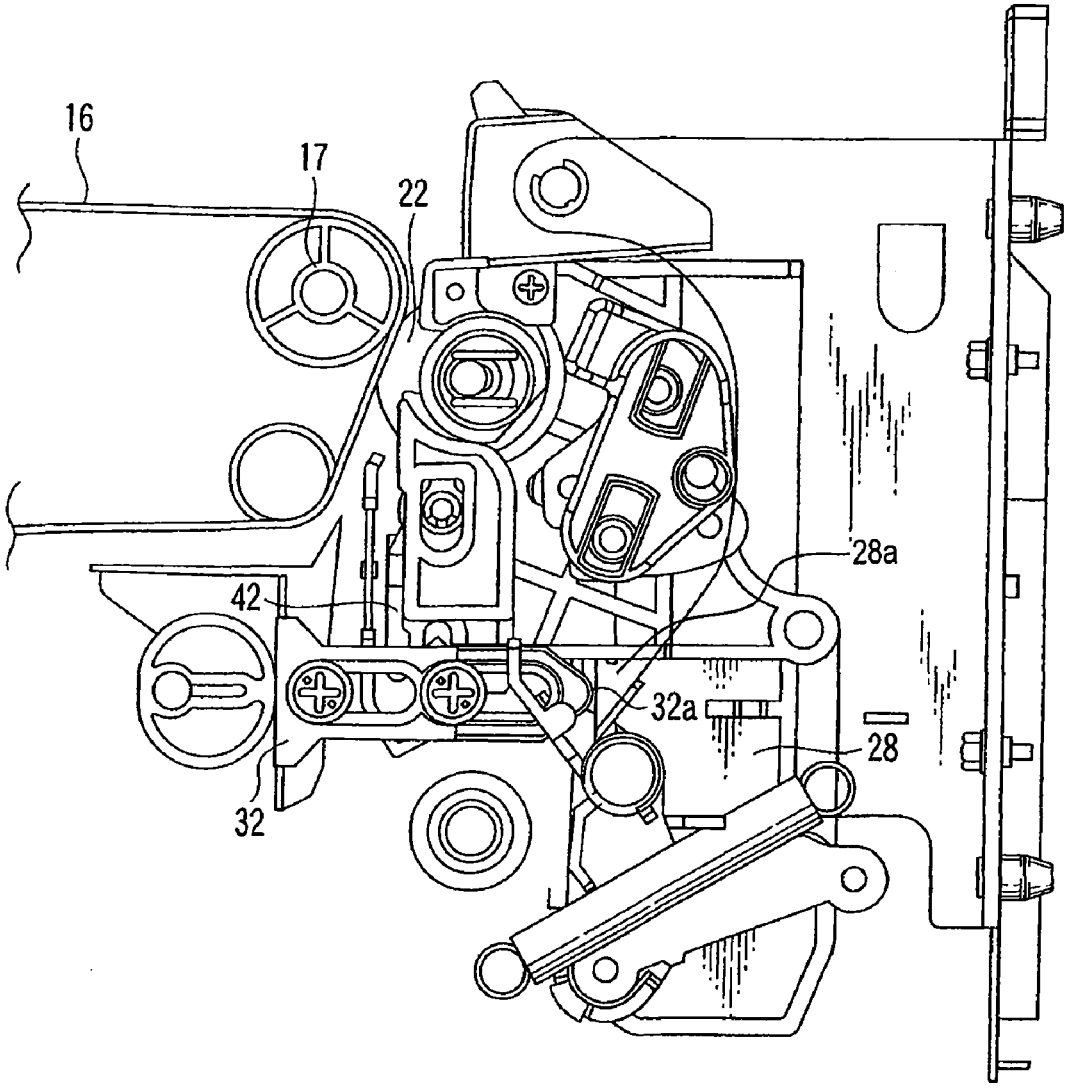
FIG. 5 is a diagram for explaining a contact and separation operation of the secondary transfer roller.

FIG. 5 is a diagram for explaining a contact and separation operation of the secondary transfer roller 22.

As shown in FIG. 5, both ends of the secondary transfer roller 22 are rotatably supported by a pair of lever-like members 28 serving as a contact and separation mechanism. In other words, the secondary transfer roller 22 is supported to be movable between a first position and a second position. The respective lever-like members 28 are capable of swinging with these substantially upper positions in a longitudinal direction as fulcrums. The respective lever-like members 28 are always urged by an elastic force of not-shown springs in a direction of bringing the secondary transfer roller 22 into contact with the transfer belt 16.

Pushers 32 are disposed near lower ends 28*a* of the lever-like members 28, respectively. Distal ends 32*a* of the pushers 32 press the lower ends 28*a* of the lever-like members 28, whereby the lever-like members 28 swing against the elastic force of the springs. Consequently, the secondary transfer roller 22 can be separated from the transfer belt 16. On the other hand, the distal ends 32*a* of the pushers 32 separate from the lever-like members 28, whereby the lever-like members 28 swing with the elastic force of the springs to positions for bringing the secondary transfer roller 22 into contact with the transfer belt 16.

Figure 6:
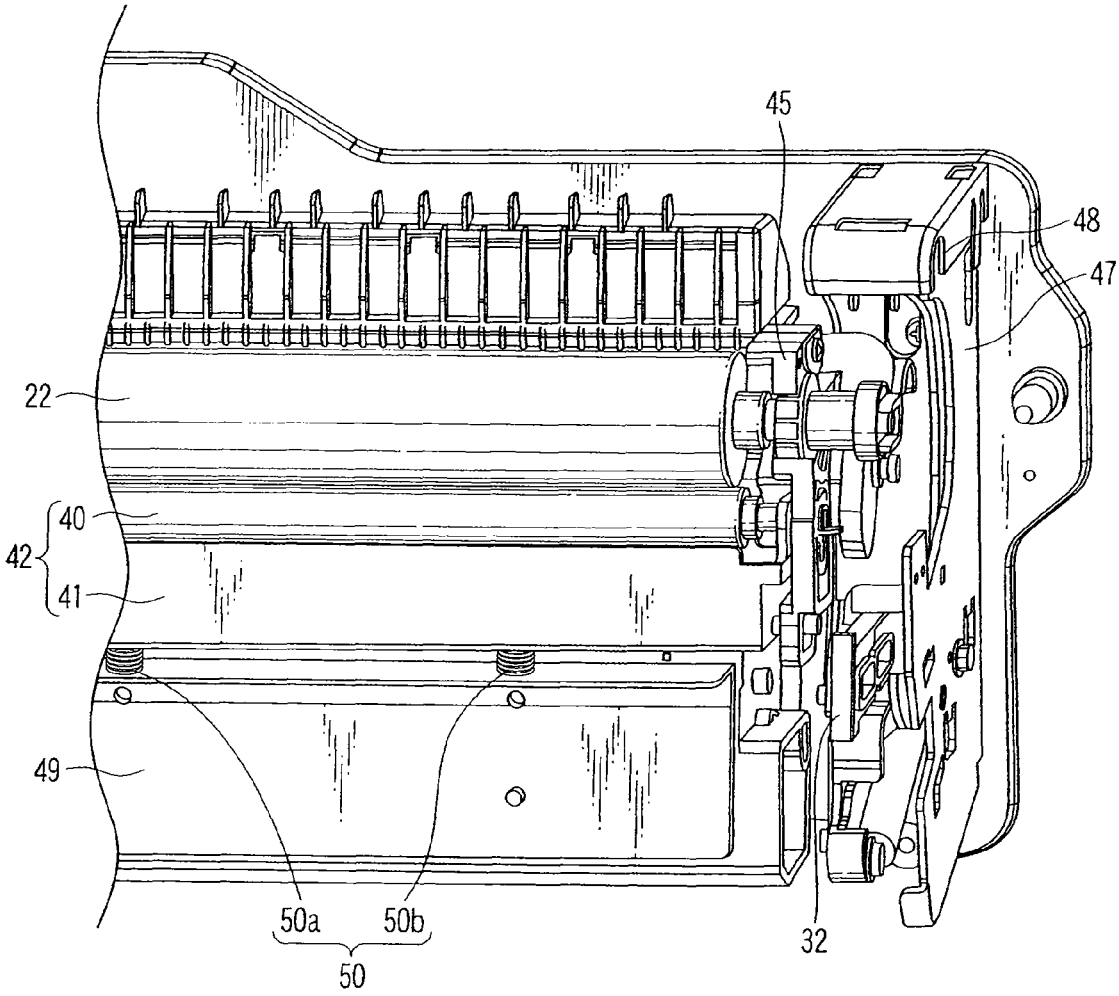
FIG. 6 is a diagram showing the secondary transfer roller, the fur brush unit, and the like in a state in which the pre-transfer guide is removed.

FIG. 6 is a diagram showing the secondary transfer roller 22, the fur brush unit 42, and the like in a state in which the pre-transfer guide 44 is removed.

The entire secondary transfer unit is supported by a secondary-transfer-unit holding frame 47. A fulcrum 48 is provided in an upper part of the secondary-transfer-unit holding frame 47. The fulcrum 48 is connected to the secondary-transfer-roller holding case 45. Therefore, the secondary-transfer-roller holding case 45 can rotate around the fulcrum 48. A not-shown sheet metal is provided in the secondary-transfer-roller holding case 45. As described above, the pushers 32 push the sheet metal, whereby the secondary-transfer-roller holding case 45 swings between the first position and the second position with the fulcrum 48 as a rotation axis.

A rack 49 is provided below the fur brush unit 42. Two compression springs 50*a* and 50*b* (compression springs 50) are attached between the rack 49 and the fur brush unit 42. The compression springs 50*a* and 50*b* press the fur brush unit 42.

Operations of the fur brush unit 42 during the contact and separation operation are explained.

Figure 7:
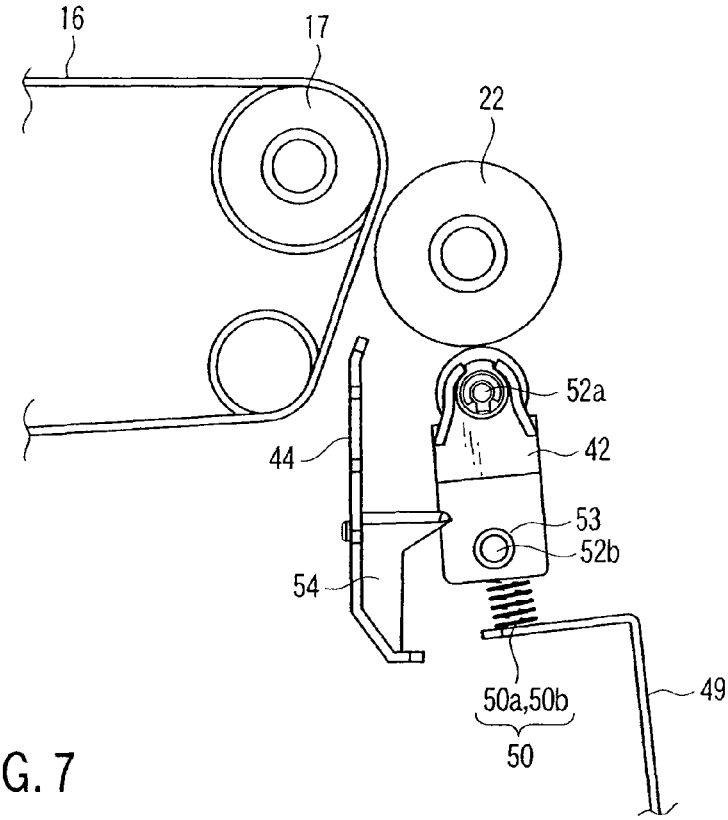
FIG. 7 is a diagram showing a state in which the secondary transfer roller is separate from a transfer belt.

FIG. 7 is a diagram showing a state in which the secondary transfer roller 22 is separate from the transfer belt 16.

During the separation, the fur brush unit 42 is pushed up by the compression springs 50 provided in the rack 49 and comes into contact with the secondary transfer roller 22. The fur brush unit 42 moves up and down along the guide groove 46. Therefore, a position where an upper shaft 52*a* comes into contact with an upper end of the guide groove 46 is an upper limit position of the operation.

As shown in FIG. 7, a member of a wedge shape in section (hereinafter referred to as an lifting and lowering member) 54 is provided in the pre-transfer guide 44. During the separation, the lifting and lowering member 54 and the fur brush unit 42 are in a non-contact state.

During transition from a separation state shown in FIG. 7 to a contact state, the secondary transfer roller 22, the fur brush unit 42, and the rack 49 integrally move in the left direction. Then, a distal end of a wedge of the lifting and lowering member 54 approaches a lower shaft 52*b*. A cylindrical member 53 made of synthetic resin such as plastic is arranged on an outer periphery of the lower shaft 52*b*. The cylindrical member 53 is configured to freely rotate around the lower shaft 52*b*. When the transition to the contact state progresses, the cylindrical member 53 and a slope of the lifting and lowering member 54 come into contact with each other.

Figure 8:
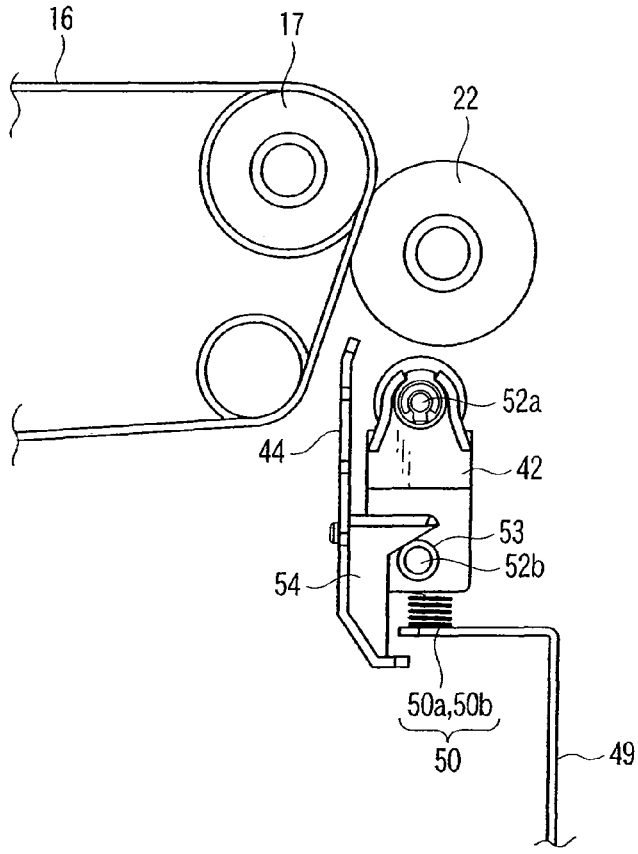
FIG. 8 is a diagram showing a state in which the secondary transfer roller is in contact with the transfer belt.

FIG. 8 is a diagram showing a state in which the secondary transfer roller 22 is in contact with the transfer belt 16.

As a position of contact of the cylindrical member 53 and the slope of the lifting and lowering member 54 moves, the fur brush unit 42 is pushed downward. Therefore, at a point when this contact operation is completed, the fur brush unit 42 and the secondary transfer roller 22 are separated from each other.

According to the progress of the contact operation, the cylindrical member 53 changes the position of contact with the lifting and lowering member 54 while rotating around the lower shaft 52*b*. Therefore, the fur brush unit 42 smoothly moves downward without being affected by an unnatural force. The lower shaft 52*b* and the lifting and lowering member 54 do not come into direct contact with each other. A material (synthetic resin) of the cylindrical member 53 is softer than a material (metal) of the lifting and lowering member 54 and the lower shaft 52*b*. Therefore, there is little abrasion between the lower shaft 52*b* and the lifting and lowering member 54 and it is possible to consume only the cylindrical member 53.

During transition from the contact state shown in FIG. 8 to the separation state shown in FIG. 7, the wedge of the lifting and lowering member 54 moves away from the lower shaft 52*b* in a manner opposite to the above explanation. Therefore, the fur brush unit 42 is pushed upward by the compression springs 50*a* and 50*b* (compression springs 50). At a point when the separation operation is completed, the fur brush unit 42 and the secondary transfer roller 22 come into contact with each other.

In the first embodiment explained above, the fur brush 40 separates from the secondary transfer roller 22 when the secondary transfer roller 22 comes into contact with the transfer belt 16. The fur brush 40 comes into contact with the secondary transfer roller 22 when the secondary transfer roller 22 separates from the transfer belt 16. As a result, compared with the system in the past in which the fur brush 40 is always in contact with the secondary transfer roller 22, it is possible to prevent the lubricant from being excessively applied to the secondary transfer roller 22.

Second Embodiment

In a second embodiment of the present invention, a contact and separation operation of the secondary transfer roller 22 and the fur brush 40 and a mechanism therefor are different from those in the first embodiment. Therefore, components identical with those in the first embodiment are denoted by the same reference numerals and signs and explanation of details of the components is omitted.

Figure 9:
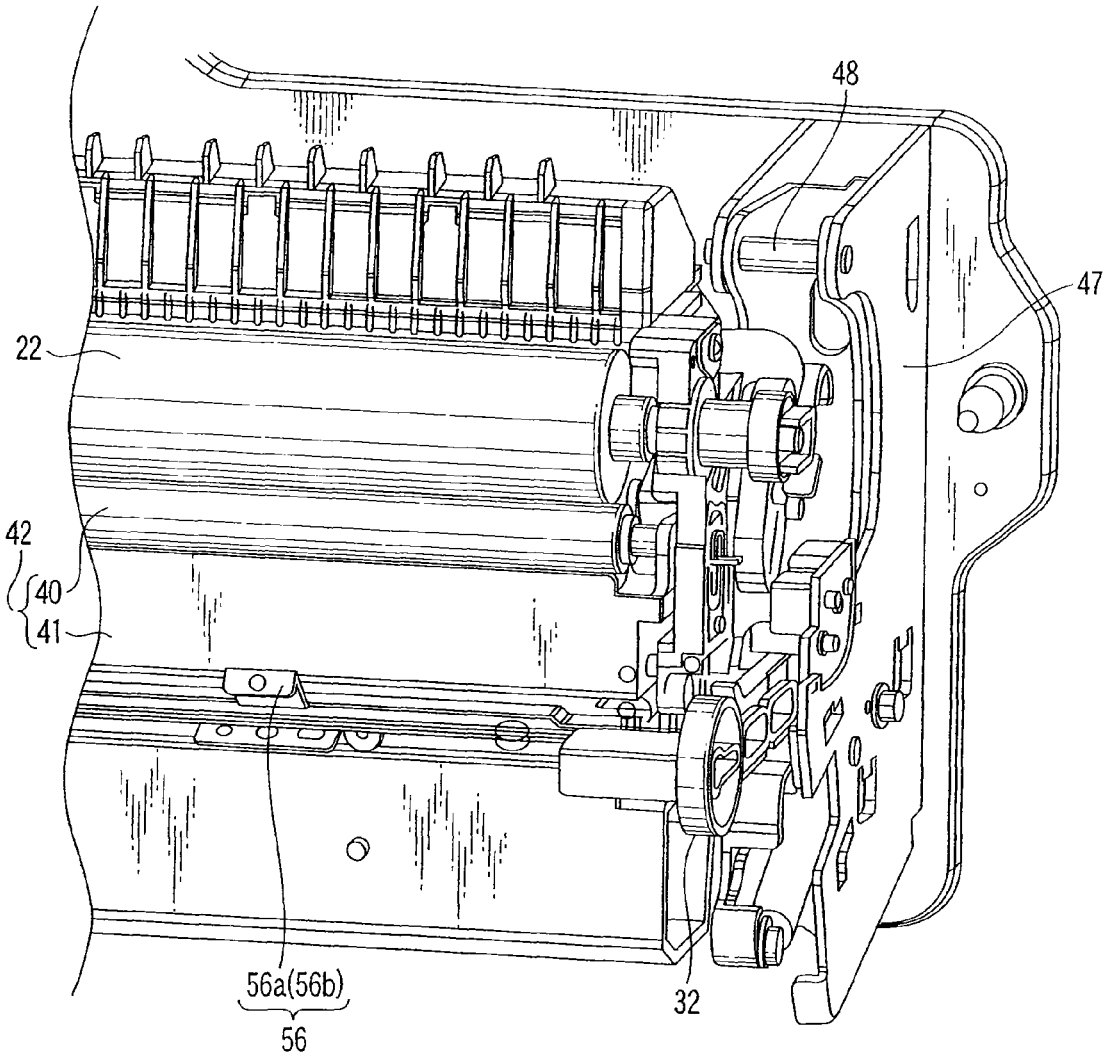
FIG. 9 is a diagram showing the secondary transfer roller, the fur brush unit, and the like in a state in which a part of the pre-transfer guide is not shown.

FIG. 9 is a diagram showing the secondary transfer roller 22, the fur brush unit 42, and the like in a state in which a part of the pre-transfer guide 44 is not shown.

The entire secondary transfer unit is supported by the secondary-transfer-unit holding frame 47. The fulcrum 48 is provided in the upper part of the secondary-transfer-unit holding frame 47. The fulcrum 48 is connected to the secondary-transfer-roller holding case 45. Therefore, the secondary-transfer-roller holding case 45 can rotate around the fulcrum 48. The not-shown sheet metal is provided in the secondary-transfer-roller holding case 45. As described above, the pushers 32 push the sheet metal, whereby the secondary-transfer-roller holding case 45 swings between the first position and the second position with the fulcrum 48 as a rotation axis.

Leaf spring members (hereinafter referred to as lifting and lowering members) 56*a* and 56*b* (lifting and lowering members 56) are provided on a front side and a rear side below the fur brush unit 42. The lifting and lowering members 56*a* and 56*b* are attached to the pre-transfer guide 44. When the secondary transfer roller 22 comes into contact with the transfer belt 16, the lifting and lowering members 56*a* and 56*b* press the fur brush unit 42.

Figure 10:
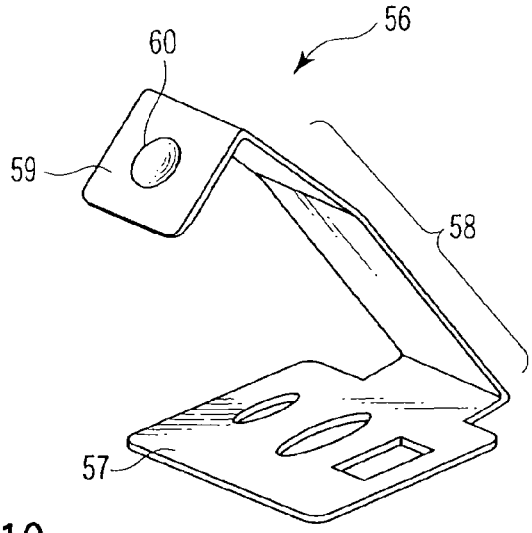
FIG. 10 is a perspective view showing a lifting and lowering member.
Figure 11:
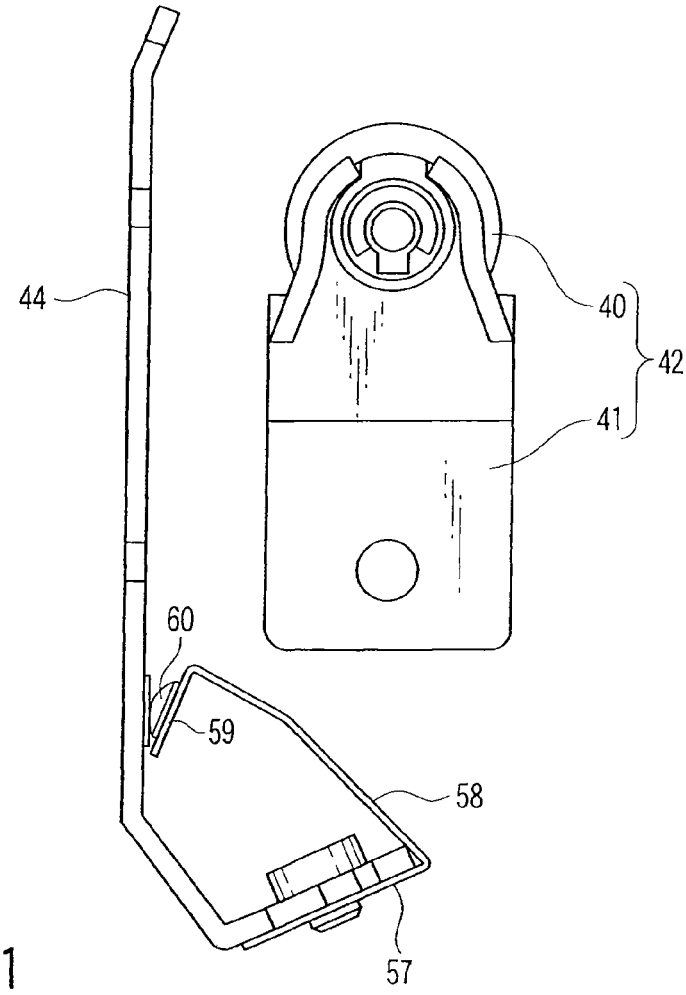
FIG. 11 is a diagram showing a state in which the lifting and lowering member is attached to the pre-transfer guide.

FIG. 10 is a perspective view showing one of the lifting and lowering members 56. FIG. 11 is a diagram showing a state in which the lifting and lowering member 56 is attached to the pre-transfer guide 44.

The lifting and lowering member 56 includes an attaching section 57, an intermediate section 58, and a distal end section 59. A hole for inserting a member for connecting the lifting and lowering member 56 to the pre-transfer guide 44, for example, a bolt is provided in the attaching section 57. The intermediate section 58 is folded in two stages and has two areas. An area close to the distal end section 59 of the intermediate section 58 and the fur brush unit 42 come into contact with each other. The intermediate section 58 is folded in two stages in order to effectively show a function of the leaf spring by setting a contact angle of the intermediate section 58 and the fur brush unit 42 to a predetermined angle. Therefore, the number of folding stages is not limited to two and may be three or more. In other words, two or more areas may be formed in the intermediate section 58.

A boss 60 as a projecting section is formed in the distal end section 59. When the fur brush unit 42 comes into contact with the intermediate section 58, the boss 60 and the pre-transfer guide 44 come into contact with each other, whereby the lifting and lowering member 56 functions as the leaf spring and presses the fur brush unit 42 upward. A shape of the boss 60 is a spherical surface such that the boss 60 and the pre-transfer guide 44 come into contact with each other at one point. However, since the contact of the boss 60 and the pre-transfer guide 44 only has to be a point contact, the shape of the boss 60 is not limited to the spherical surface and only has to be a shape of a convex curved surface.

Operations of the fur brush unit 42 during the contact and separation operation are explained.

Figure 12:
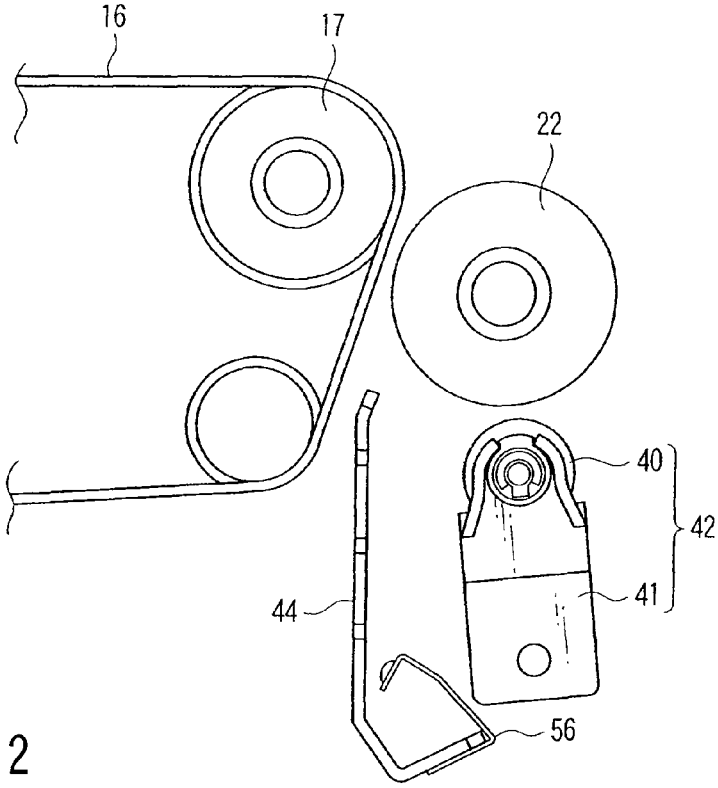
FIG. 12 is a diagram showing a state in which the secondary transfer roller is separate from the transfer belt.

FIG. 12 is a diagram showing a state in which the secondary transfer roller 22 is separate from the transfer belt 16.

During the separation, the fur brush unit 42 is in a non-contact state with the lifting and lowering member 56. During transition from the separation state shown in FIG. 12 to the contact state, the secondary transfer roller 22 and the fur brush unit 42 integrally moves in the left direction. When the transition to the contact state progresses, a lower part of the fur brush unit 42 approaches the intermediate section 58 and, before long, the lower part of the fur brush unit 42 and the intermediate section 58 come into contact with each other.

Then, the lifting and lowering member 56 is pressed and the boss 60 and the pre-transfer guide 44 come into contact with each other, whereby the lifting and lowering member 56 functions as the leaf spring and presses the fur brush unit 42 upward. As a result, the fur brush unit 42 is pushed up and comes into contact with the secondary transfer roller 22.

In this way, the lifting and lowering member 56 approaches to come into contact with the pre-transfer guide 44 while bending during the contact of the secondary transfer roller 22. However, after the boss 60 and the pre-transfer guide 44 come into contact with each other, the lifting and lowering member 56 receives a reaction from the pre-transfer guide 44 and deformation of the leaf spring is controlled. Since the reaction is received from the pre-transfer guide 44, a stress is prevented from being concentratedly exerted on the leaf spring.

Figure 13:
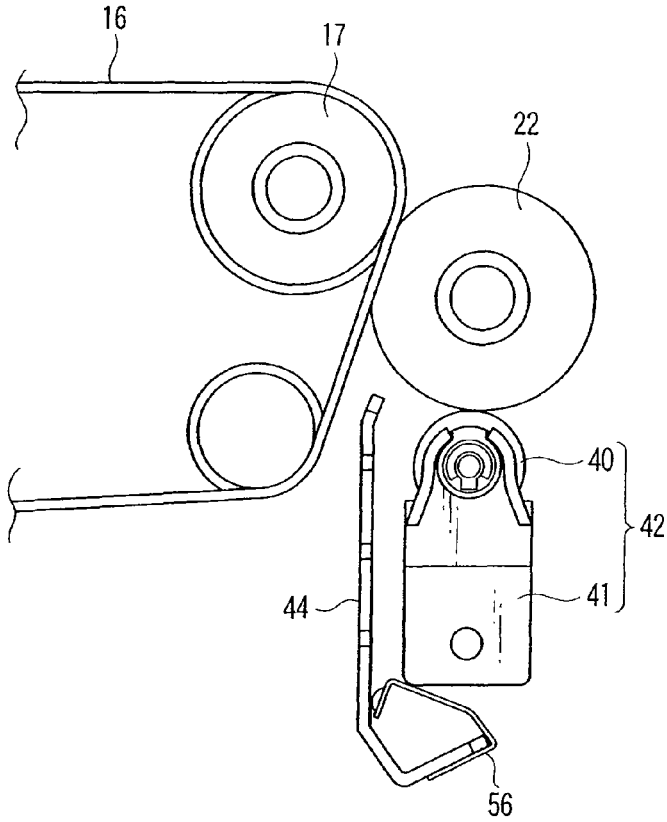
FIG. 13 is a diagram showing a state in which the secondary transfer roller is in contact with the transfer belt.

FIG. 13 is a diagram showing a state in which the secondary transfer roller 22 is in contact with the transfer belt 16.

As a position of contact of the fur brush unit 42 and the intermediate section 58 of the lifting and lowering member 56 moves, the fur brush unit 42 is pushed upward. At a point when this contact operation is completed, the fur brush unit 42 and the secondary transfer roller 22 are in contact with each other.

During transition from the contact state shown in FIG. 13 to the separation state shown in FIG. 12, the position of contact of the fur brush unit 42 and the intermediate section 58 of the lifting and lowering member 56 changes in a direction opposite to the direction in the above explanation. Therefore, a pressing force by the lifting and lowering member 56 gradually decreases. During the separation, the fur brush unit 42 is separate from the lifting and lowering member 56.

In the second embodiment explained above, the fur brush 40 comes into contact with the secondary transfer roller 22 when the secondary transfer roller 22 comes into contact with the transfer belt 16. The fur brush 40 separates from the secondary transfer roller 22 when the secondary transfer roller 22 separates from the transfer belt 16.

In the related art in which the fur brush 40 is always in contact with the secondary transfer roller 22, problems described below are pointed out. When recording paper causes jamming or when the recording paper is not supplied because of paper empty or the like, the secondary transfer roller 22 continues to rotate with a transferred toner kept applied thereto. In such a case, it is possible to clean the secondary transfer roller 22 to a certain degree by the cleaning blade 43. However, when the toner remains, the toner soils the fur brush 40 that is always in contact with the secondary transfer roller 22. In the second embodiment, such soiling of the fur brush 40 can be prevented.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

an image transfer unit configured to transfer a reversed image based on a scanned original image onto an image bearing member as a toner image;

a secondary transfer roller that comes into contact with the image bearing member and transfers the toner image onto a recording medium;

a contact and separation unit configured to bring the secondary transfer roller into contact with and separate the secondary transfer roller from the image bearing member;

a secondary-transfer-roller housing unit configured to house the secondary transfer roller;

a lubricant applying brush that comes into contact with the secondary transfer roller and applies a lubricant thereto;

a lubricant-applying-brush housing unit configured to house the lubricant applying brush and to be movable along a groove provided in the secondary-transfer-roller housing unit;

a lifting and lowering member that is provided in another member not associated with the secondary-transfer-roller housing unit and lifts and lowers the lubricant-applying-brush housing unit; and a pressing member that presses the lubricant-applying-brush housing unit and brings the lubricant applying brush into contact with the secondary transfer roller wherein:

the secondary transfer roller and the lubricant applying brush come into contact with and separate from each other in response to a contact and separation operation of the secondary transfer roller and the image bearing member, the secondary transfer roller and the lubricant applying brush separate from each other when the secondary transfer roller comes into contact with the image bearing member and come into contact with each other when the secondary transfer roller separates from the image bearing member, the lifting and lowering member limits, when the secondary transfer roller comes into contact with the image bearing member, the movement of the lubricant-applying-brush housing unit along the groove and releases the limitation when the secondary transfer roller separates from the image bearing member, the lubricant-applying-brush housing unit has a support shaft that is inserted in the groove and guides the movement of the lubricant-applying-brush housing unit, and the lifting and lowering member moves, while the secondary transfer roller is moving in a direction of coming into contact with the image bearing member, the support shaft in a direction in which the secondary transfer roller and the lubricant applying brush separate from each other and moves, while the secondary transfer roller is moving in a direction of separating from the image bearing member, the support shaft in a direction in which the secondary transfer roller and the lubricant applying brush come into contact with each other.

2. An image forming apparatus according to claim 1, wherein the lifting and lowering member comes into contact with a cylindrical member rotatably provided around the support shaft.

3. An image forming apparatus comprising:

an image transfer unit configured to transfer a reversed image based on a scanned original image onto an image bearing member as a toner image;

a secondary transfer roller that comes into contact with the image bearing member and transfers the toner image onto a recording medium;

a contact and separation unit configured to bring the secondary transfer roller into contact with and separate the secondary transfer roller from the image bearing member;

a secondary-transfer-roller housing unit configured to house the secondary transfer roller;

a lubricant applying brush that comes into contact with the secondary transfer roller and applies a lubricant thereto;

a lubricant-applying-brush housing unit configured to house the lubricant applying brush and to be movable along a groove provided in the secondary-transfer-roller housing unit;

a pressing member that presses the lubricant-applying-brush housing unit and brings the lubricant applying brush into contact with the secondary transfer roller; and a lifting and lowering member that is provided in another member not associated with the secondary-transfer-roller housing unit and lifts and lowers the lubricant-applying-brush housing unit, wherein the secondary transfer roller and the lubricant applying brush come into contact with and separate from each other in response to a contact and separation operation of the secondary transfer roller and the image bearing member, the secondary transfer roller and the lubricant applying brush separate from each other when the secondary transfer roller comes into contact with the image bearing member and come into contact with each other when the secondary transfer roller separates from the image bearing member, the pressing member is an elastic member arranged between a rack associated with the secondary-transfer-roller housing unit and the lubricant-applying-brush housing unit, and the lifting and lowering member presses, when the secondary transfer roller comes into contact with the image bearing member, the lubricant-applying-brush housing unit against the rack via the pressing member and limits the movement of the lubricant-applying-brush housing unit along the groove and reduces, when the secondary transfer roller separates from the image bearing member, a force of pressing the lubricant-applying-brush housing unit against the rack and releases the limitation.

4. An image forming apparatus according to claim 3, wherein the lubricant-applying-brush housing unit has a support shaft that is inserted in the groove and guides the movement of the lubricant-applying-brush housing unit, and the lifting and lowering member comes into contact with and moves, when the secondary transfer roller is moving in a direction of coming into contact with the image bearing member, the support shaft in a direction of pressing the lubricant-applying-brush housing unit against the rack and moves, when the secondary transfer roller is moving in a direction of separating from the image bearing member, the support shaft in a direction of reducing a force of pressing the lubricant-applying-brush housing unit against the rack.

5. An image forming apparatus according to claim 4, wherein the lifting and lowering member and the support shaft come into contact with a cylindrical member rotatably provided around the support shaft.

6. An image forming apparatus according to claim 5, wherein a plurality of the pressing members are provided on the rack along an axial direction of the secondary transfer roller.

7. An image forming apparatus comprising:

an image transfer unit configured to transfer a reversed image based on a scanned original image onto an image bearing member as a toner image;

a secondary transfer roller that comes into contact with the image bearing member and transfers the toner image onto a recording medium;

a contact and separation unit configured to bring the secondary transfer roller into contact with and separate the secondary transfer roller from the image bearing member;

a secondary-transfer-roller housing unit configured to house the secondary transfer roller;

a lubricant applying brush that comes into contact with the secondary transfer roller and applies a lubricant thereto;

a lubricant-applying-brush housing unit configured to house the lubricant applying brush and to be movable along a groove provided in the secondary-transfer-roller housing unit; and a lifting and lowering member that is provided in another member not associated with the secondary-transfer-roller housing unit and lifts and lowers the lubricant-applying-brush housing unit the lifting and lowering member including:

an attaching section for connecting the lifting and lowering member and the another member;

an intermediate section that comes into contact with the lubricant-applying-brush housing unit during the contact and separation operation of the secondary transfer roller; and a distal end section that comes into contact with the another member during the contact and separation operation of the secondary transfer roller, and the lifting and lowering member presses the lubricant-applying-brush housing unit when the distal end portion and the another member come into contact with each other; wherein the secondary transfer roller and the lubricant applying brush come into contact with and separate from each other in response to a contact and separation operation of the secondary transfer roller and the image bearing member, and the secondary transfer roller and the lubricant-applying brush come into contact with each other when the secondary transfer roller comes into contact with the image bearing member and separate from each other when the secondary transfer roller separates from the image bearing member.

8. An image forming apparatus according to claim 7, wherein the distal end section has a projecting member of a curved surface shape that comes into contact with the another member, the intermediate section has at least two areas to be bent, and the lubricant-applying brush housing unit comes into contact with one of the areas during the contact and separation operation of the secondary transfer roller.

9. An image forming apparatus according to claim 7, wherein the attaching section forms one end of the lifting and lowering member, the distal end section forms the other end of the lifting and lowering member, and the intermediate section forms an intermediate portion of the lifting and lowering member.

10. An image forming apparatus according to claim 9, wherein the intermediate section of the lifting and lowering member is formed to have an angle with respect to the attaching section and the distal end section such that a surface on a side that comes into contact with the lubricant-applying-brush housing unit is formed in a convex shape.

11. An image forming apparatus according to claim 10, wherein a surface on a side that comes into contact with the lubricant-applying-brush housing unit of the distal end section has a projecting member of a curved surface shape that comes into contact with the another member, the intermediate section has at least two areas to be bent, and the lubricant-applying brush housing unit comes into contact with one of the areas during the contact and separation operation of the secondary transfer roller.

* * * * *